US009380695B2

(12) United States Patent
Dolgashev

(10) Patent No.: US 9,380,695 B2
(45) Date of Patent: Jun. 28, 2016

(54) TRAVELING WAVE LINEAR ACCELERATOR WITH RF POWER FLOW OUTSIDE OF ACCELERATING CAVITIES

(71) Applicant: The Board of Trustees of the Leland Stanford Junior University, Palo Alto, CA (US)

(72) Inventor: Valery A. Dolgashev, San Carlos, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/730,883

(22) Filed: Jun. 4, 2015

(65) Prior Publication Data

US 2015/0359080 A1 Dec. 10, 2015

Related U.S. Application Data

(60) Provisional application No. 62/007,817, filed on Jun. 4, 2014.

(51) Int. Cl.
*H05H 9/00* (2006.01)
*H05H 7/02* (2006.01)
*H05H 9/02* (2006.01)

(52) U.S. Cl.
CPC . *H05H 7/02* (2013.01); *H05H 9/02* (2013.01); *H05H 2007/025* (2013.01)

(58) Field of Classification Search
CPC ..... H05H 7/02; H05H 7/22; H05H 9/00
USPC ..... 315/5.35, 5.41–5.46, 500–505
See application file for complete search history.

(56) References Cited

U.S. PATENT DOCUMENTS

| | | | | | |
|---|---|---|---|---|---|
| 3,546,524 | A * | 12/1970 | Stark | H05H 9/04 | 315/5.41 |
| 4,024,426 | A | 5/1977 | Vaguine | | |
| 4,122,373 | A | 10/1978 | Vaguine | | |
| 4,162,423 | A | 7/1979 | Tran | | |
| 4,746,839 | A | 5/1988 | Kazusa | | |
| 5,039,910 | A | 8/1991 | Moriguchi | | |
| 5,380,386 | A * | 1/1995 | Oldham | H01P 11/00 | 156/150 |
| 5,959,406 | A * | 9/1999 | Hart | H01J 23/087 | 29/600 |

(Continued)

OTHER PUBLICATIONS

Schaffer, G., "High Power UHF Components for DESY," 1st IEEE Particle Accelerator Conference, Washington, DC, USA, Mar. 10-12, 1965, pp. 208.

(Continued)

*Primary Examiner* — Tung X Le
(74) *Attorney, Agent, or Firm* — Lumen Patent Firm

(57) ABSTRACT

A high power RF traveling wave accelerator structure includes a symmetric RF feed, an input matching cell coupled to the symmetric RF feed, a sequence of regular accelerating cavities coupled to the input matching cell at an input beam pipe end of the sequence, one or more waveguides parallel to and coupled to the sequence of regular accelerating cavities, an output matching cell coupled to the sequence of regular accelerating cavities at an output beam pipe end of the sequence, and output waveguide circuit or RF loads coupled to the output matching cell. Each of the regular accelerating cavities has a nose cone that cuts off field propagating into the beam pipe and therefore all power flows in a traveling wave along the structure in the waveguide.

4 Claims, 7 Drawing Sheets

(56) References Cited

U.S. PATENT DOCUMENTS

| | | | | |
|---|---|---|---|---|
| 6,316,876 | B1 | 11/2001 | Tanabe | |
| 6,407,505 | B1 * | 6/2002 | Bertsche | H05H 9/04 315/5.41 |
| 6,646,383 | B2 | 11/2003 | Bertsche | |
| 7,339,320 | B1 | 3/2008 | Meddaugh | |
| 7,423,381 | B2 | 9/2008 | Hanna | |
| 8,232,749 | B1 * | 7/2012 | Barov | H05H 7/18 315/5.41 |
| 2005/0212465 | A1 * | 9/2005 | Zavadtsev | H05H 7/00 315/500 |
| 2007/0120508 | A1 | 5/2007 | Hanna | |
| 2011/0006708 | A1 * | 1/2011 | Ho | H05H 9/04 315/505 |
| 2014/0191654 | A1 | 7/2014 | Tantawi | |

OTHER PUBLICATIONS

Sundelin et al., "Parallel Coupled Cavity Structure," 7th IEEE Particle Accelerator Conference, Chicago, IL, USA, Mar. 16-18, 1977, pp. 1686.

Chernousov et al., "Prototype of parallel coupled accelerating structure," Proceedings of EPAC08, Genoa, Italy, Jun. 23 to 27, 2008, pp. 2737.

* cited by examiner

TRAVELING WAVE LINEAR ACCELERATOR WITH RF POWER FLOW OUTSIDE OF ACCELERATING CAVITIES

CROSS-REFERENCE TO RELATED APPLICATIONS

This application claims priority from U.S. Provisional Patent Application 62/007,817 filed Jun. 4, 2014, which is incorporated herein by reference.

STATEMENT OF GOVERNMENT SPONSORED SUPPORT

This invention was made with Government support under grant (or contract) no. DE-AC02-76SF00515 awarded by the Department of Energy. The Government has certain rights in the invention.

FIELD OF THE INVENTION

The present invention relates generally to high power RF devices. More specifically, it relates to accelerating waveguide structures for linear accelerators.

BACKGROUND OF THE INVENTION

An accelerating structure is a critical component of particle accelerators for medical, security, industrial and scientific applications. Standing-wave side-coupled accelerating structures are used where available RF power is at a premium, while average current is high and average power lost in the structure is high. These structures are expensive to manufacture and typically require a circulator; a device that diverts structure-reflected power away from RF source, klystron or magnetron.

SUMMARY OF THE INVENTION

In one aspect, the invention provides a traveling wave accelerating structure that advantageously combines simplicity of tuning and manufacturing of traveling wave waveguide with high shunt impedance of side-coupled standing wave accelerating structure. This improves efficiency while reducing cost and enhancing operational flexibility of particle accelerators for medical, security and industrial applications. In addition, the traveling wave structure is matched to the RF source so no circulator is needed.

A traveling wave waveguide according to the invention may be used to accelerate charged particles such as electrons and protons. Embodiments of the invention use a traveling wave in combination with accelerating cavities which could be isolated at the beam pipe. This design improves efficiency while reducing cost and improving operational flexibility of particle accelerators. Although advantages of this invention are evident when the accelerating cavities are not coupled thorough the beam pipe, some coupling through the beam pipe is allowed, which provides additional possible applications.

The structure includes one or more parallel waveguides which are loaded by accelerating cavities. This circuit allows configurations where no RF power is flowing through the accelerating cavity while maintaining a traveling RF wave through the cross-section of the accelerating structure. The cavities have a so-called beam pipe that allows the accelerated particles to cross the accelerating cavity without being intercepted by the cavity walls. This absence of the power flow through the accelerating cavity allows configurations where no power flows through the beam pipe.

The design is cost efficient, easier to manufacture and tune then the existing high-efficiency accelerating structures. It enhances operational and design flexibility, and it does not need circulator to operate.

The practical high shunt impedance traveling wave structures of the present invention are an improvement over both existing traveling wave and standing wave accelerating structures. Conventional traveling wave structures typically use coupling RF power through the beam hole. This requirement constrains its shunt impedance to relatively small values. Embodiments of the present invention are free from this limitation.

Side-coupled standing wave structures have similar shunt impedance to embodiments of this invention but they more complex to manufacture and tune. Plus they require expensive power isolators to operate. Embodiments of the present invention are free from this limitation.

The present invention also provides structures with flexible profile of RF losses along structure, which is impractical in the state of the art traveling wave structures.

In existing standing and traveling wave structures, RF power flows through the accelerating cells. This power flow increases the probability of faults, or vacuum RF breakdowns. With embodiments of the present invention, absence of power flow through the cavities is beneficial for fault-free operation of the accelerator.

There are existing standing-wave accelerating structures in which power is coupled into an accelerating cell or a set of accelerating cells using an outside waveguide. In contrast to these, embodiments of the present invention provide traveling wave accelerating structures that are practical in construction, tuning, and do not need a circulator to operate.

Embodiments of the invention may be designed for use at arbitrary RF frequency. They could have different numbers of power coupling waveguides. The accelerating cavity may be shaped according to requirements of a specific accelerator. The power couplers that match impedance of this structure to RF feeding waveguides could have different configurations, depending on requirements.

Since no power flow through the beam hole is needed, focusing elements could be placed between the accelerating cavities.

Embodiments of the invention could be used to accelerate electrons, protons, or other charged particles in scientific, industrial, security and medical particle accelerators. It could be used in accelerators where RF power is premium: Compact accelerators for radiation therapy, compact and high repetition rate accelerators for security and imaging applications, and compact, high dose industrial accelerators for sterilization.

In one aspect, the invention provides a traveling wave accelerator structure including a symmetric RF feed; this symmetric feed eliminates transverse fields that deflect the accelerated beam which is of importance especially at low energies; an input matching cell coupled to the symmetric RF feed, this matching cell (or set of matching cells) transforms field of the rectangular waveguide into traveling wave in the waveguide loaded by the accelerating cavities; a waveguide loaded by a sequence of regular accelerating cells coupled to the input matching cell at an input beam pipe end of the sequence; a waveguide parallel to and loaded by the sequence of regular accelerating cells, an output matching cell (or set of matching cells) coupled to the sequence of regular cells at an output beam pipe end of the sequence, this matching cells transforms traveling wave of the waveguide loaded with the accelerating cells into field of a rectangular waveguide for further extraction out of the structure; and output waveguide circuit or RF loads coupled to the output matching cell or cells. In a possible configuration each of the regular accelerating cells has a nose cone. This nose cone increases accelerating efficiency or shunt impedance of the accelerating cell. While increasing the shunt impedance, this nose cone cuts-off field propagating into the beam pipe whereby all power flows along the structure in the waveguide. A main feature of this invention which differentiates it from side-coupled standing-wave structures that also use nose cones is that in the side-coupled-standing-wave-structure the RF power flows through the accelerating cavities and in embodiments of this invention power flows through the outside waveguide or waveguides.

The symmetric RF feed is preferably an input waveguide circuit comprising an input waveguide, matched splitter, two matched H-plane bends, and a matched E-plane bend. The structure may include multiple input matching cells coupled to the symmetric RF feed. The matching cells will have few critical dimensions such as internal cavity diameter and size of the hole coupling the cavity to the outside waveguide which are different from that of the regular accelerating cavities. This difference is determined during the RF design, where the dimensions are optimized to transform all power coming from input waveguide into power of the wave traveling in the periodic structure made of the waveguide loaded by regular accelerating cavities. The dimensions of the output matching cells are determined by similar optimization.

The regular cells may have different lengths from input to output to facilitate bunching of the beam and to match velocity of the beam when accelerated from low energies.

DETAILED DESCRIPTION

Figure 1A:
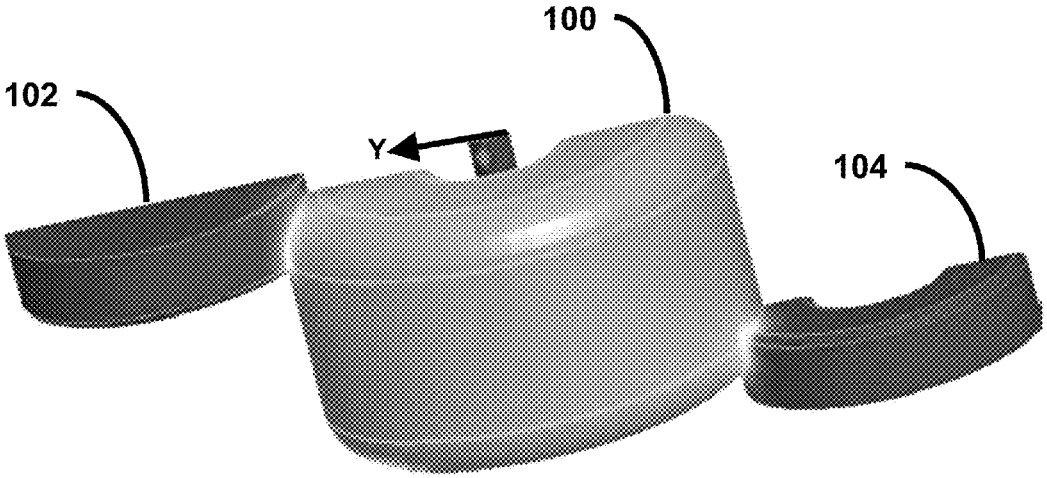
Fig. 1A (Prior Art)
FIGS. 1A and 1B are perspective views of a finite element model of a half-cell of a conventional side-coupled standing wave accelerating structure.
Figure 1B:
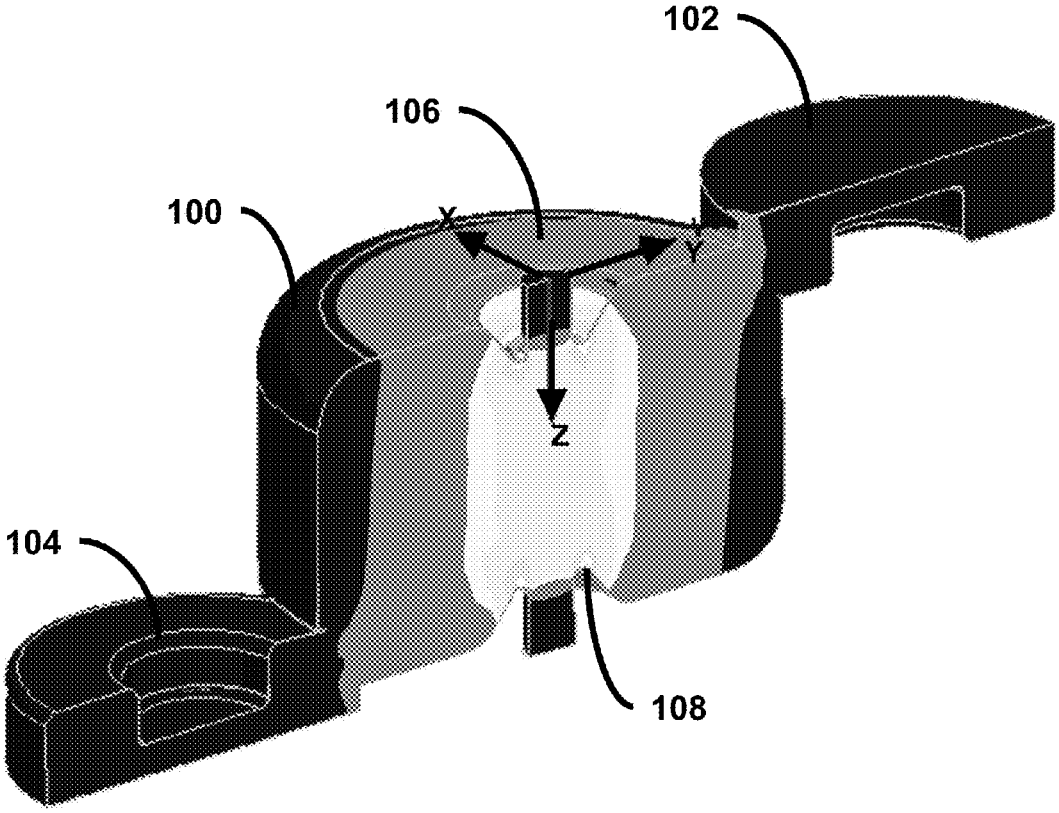
Fig. 1B (Prior Art)

To better appreciate the present invention, consider first a typical side-coupled standing wave (SW) accelerating structure. As shown in FIGS. 1A-1B, a cell of a typical side-coupled standing wave accelerating structure has a central accelerator cavity 100 with beam pipe 106, nose cone 108, and two coupling cavities 102 and 104. This accelerating structure is a bi-periodic system that works at $\pi/2$ resonant mode. In the working mode, most of electro-magnetic fields are in the accelerating cells. The cavities are coupled magnetically with the coupling slots located near the outer diameter of the accelerating cavity. Surface fields are normalized to 100 MV/m accelerating gradient. The shading in FIG. 1A is indicative of magnetic fields with peak magnitude of ~1.5 MA/m, while the shading in FIG. 1B is indicative of electric fields with peak magnitude ~550 MV/m. Further details of this design are contained, for example, in U.S. Pat. Nos. 6,316,876 and 5,039,910. This type of accelerator is widely used in medical, industrial and security applications because it offers very high shunt impedance and operational stability. For example, this high shunt impedance permits positioning of the complete accelerator on arm of a robot for radiosurgery, such as in devices manufactured by Accuray Incorporated.

The coupling slots in the side-coupled SW structure are located asymmetrically with respect to the axis where electrons or other charged particles are accelerated. This asymmetry as well as power flow through the accelerating cell creates electric and magnetic fields deflecting the beam off its axis. This deflection distorts the beam, especially during initial stages of acceleration, increasing beam losses and creating an uneven pattern on the x-ray target thus reducing the performance of the system.

The side-coupled SW structures are typically brazed in pieces, where each piece includes one half of accelerating cavity and one half of coupling cell. When joined, two such pieces create the cavity shown in FIGS. 1A-B. The complexity of the joint's surface complicates the brazing so each accelerating cavity and each coupling cell has to be tuned. The tuning is done to insure the desired field profile and make the frequencies of coupling and accelerating cells the same. The tuning is made difficult by the small fields in the coupling cell. This low field prevents tuning of this cell while in working configuration, so the cell typically has a hole to insert a probe or perturb the cavity volume. This complexity both increases manufacturing and tuning cost and makes it difficult to evaluate the quality of the tuned structure.

By its nature of being a resonant cavity, a standing-wave structure absorbs RF signals in a narrow frequency band. For higher efficiency, the RF loss in the structure has to be as small as practical. The lower the RF losses, the smaller the frequency span of the structure. During initial transient, when such a narrow-band structure is filled with RF power, most of the power is reflected. If this reflected power does propagate back to the RF source, it will degrade its performance or may damage it. To protect the RF source, a waveguide isolator (typically a circulator) is installed between the SW accelerating structure and RF source. The isolator, however, attenuates precious RF power in the forward direction, and it increases complexity and cost of the linac.

There is an alternative solution to this problem of narrow-band reflection. Several standing-wave structures could be connected using a waveguide hybrid so the combined reflection is directed away from the RF source toward an RF load. This solution, however, also increases complexity and cost of the system: one will need at least two accelerating structures, a waveguide hybrid and an additional set of waveguides.

During operation of an accelerating structure, vacuum arcs or RF breakdowns degrade and disrupt the structure performance. There is overwhelming experimental evidence that increased RF power flow increases the probability of RF breakdowns. In the side-coupled SW structure the power flows through both accelerating and coupling cells. If the breakdown occurs near an input coupler of the structure, almost half of input RF power could reach the breakdown site. The inventors envision that limiting the RF power available to the RF breakdown will improve its performance.

Next, consider conventional traveling wave (TW) structures, such as used at SLAC National Accelerator Laboratory. These are typically axisymmetric, so they do not deflect the accelerated beam (assuming they use input couplers with symmetrized fields). All accelerating cells are filled with electromagnetic fields, so their tuning process is simpler than tuning of side-coupled SW structures. Traveling wave structures are matched to the RF source, and so they do not need a waveguide isolator or circulator.

Despite all these advantages, the TW structures are not used in compact linacs because they have low shunt impedance. The increase of the shunt impedance is limited by the fact that RF power flows through each cell of the structure. To sustain this flow, coupling apertures cannot be reduced below a certain size. At the same time, the reduction of the aperture increases shunt impedance. As a result, the shunt impedance of TW structures is 30-50% lower than that of side coupled standing-wave structures.

Another disadvantage of the TW structures is related to the RF power flow. The whole power passes through the first accelerating cell. The higher the power flow, the higher the probability of RF breakdowns.

To improve performance of standing wave and traveling wave structures, accelerating structures with parallel coupled cavities were developed. Specifically, this approach eliminates power flow through the accelerating cell in order to decrease RF breakdown probability. However, these structures are significantly more complex in construction and tuning in comparison with both traveling-wave structures and side coupled standing-wave structures.

Similar to side-coupled SW structures, the field inside the asymmetric accelerating cells deflects the particle beam, and, as with other standing wave structures, they need a waveguide isolator or additional waveguide components to protect the RF power source.

Because of the above disadvantages of known designs, there is a need in the art for a linear accelerator having improved characteristics compared to compact side-coupled standing wave accelerators.

Figure 2:
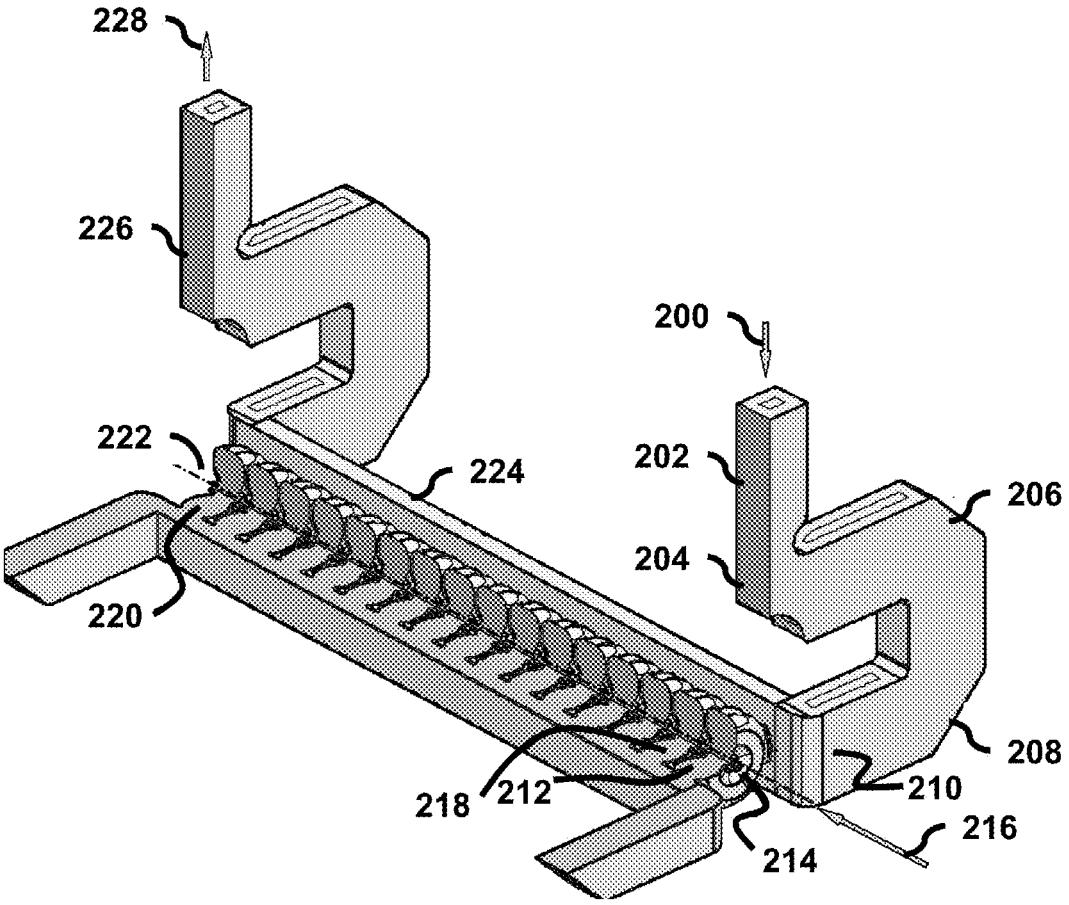
FIG. 2 is a perspective view of a vacuum region of a TW accelerating structure according to an embodiment of the invention.

FIG. 2 shows a schematic view of a vacuum region of a TW accelerating structure with power flow outside of accelerating cavities according to an embodiment of the present invention. This accelerating structure combines high shunt impedance of the side-coupled SW accelerating structure with the beneficial properties of a traveling wave structure. An upper left part of the structure is cut away to show internal geometry. The scale is for 9.3 GHz, $2\pi/3$ phase advance structure. Input RF power 200 enters; input waveguide 202 and passes through matched 3 dB splitter 204 and matched H plane bends 206, 208 followed by matched E-pane bend 210 coupled to the side of input matching cavity 212 at the input beam pipe 214 positioned around the longitudinal axis along which electron beam 216 travels. Adjacent to input matching cavity 212 along the axis is a first regular accelerating cavity 218 and subsequent set of cells arranged sequentially along the axis, terminating with output matching cavity 220 at output beam pipe 222. The power propagates from input to output through the side-coupled waveguide loaded with the accelerating cavities 224, so RF power travels through output waveguide assembly 226 and exits as output RF power 228.

Figure 3A:
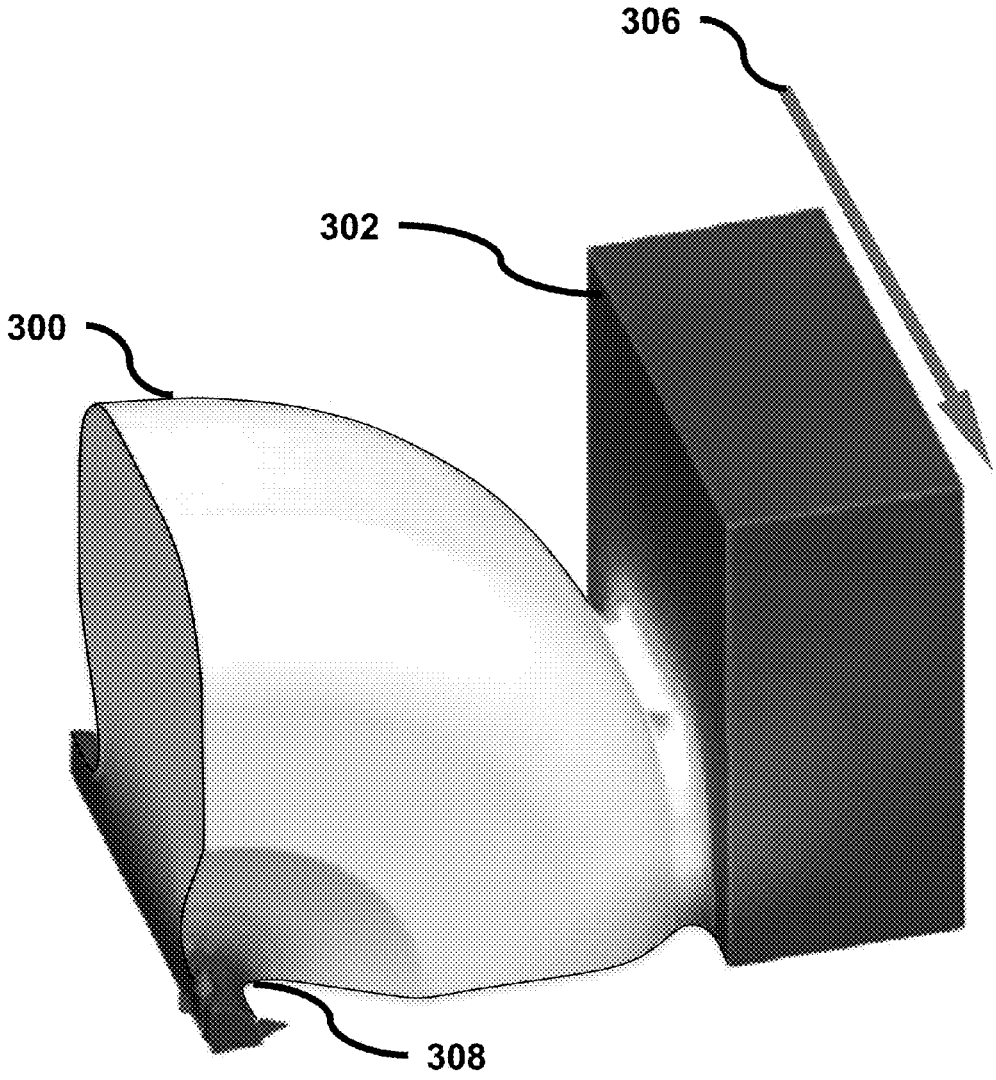
FIGS. 3A and 3B are perspective views of a quarter-cell finite element model of a traveling wave accelerating structure according to an embodiment of the invention.

The structure shown in FIG. 2 illustrates one possible concrete instantiation of the principles of the invention, and it is by no means the only possible implementation. Possible modifications within the scope of the invention include scaling to any operational frequency; replacing the input waveguide circuit with any other symmetric feed; or replacing the output circuit with two RF loads. A structure built according to this method could be designed with a field profile that accelerates electrons from low energy of ~10 keV to serve as a drop-in replacement for a side-coupled standing wave structure. The sequence of cavities connected to outside waveguides forms a periodic structure. One period of the structure is shown in more detail in FIGS. 3A-B. The cell has an accelerating cavity 300 coupled to a waveguide 302 that transmits RF power 306 between the accelerating cells. Cavity 300 has nose cone 308. The figure shows a cut-away view of a quarter-cell finite element model of the traveling wave accelerating structure. Surface electric fields are normalized to 100 MV/m accelerating gradient. FIG. 3A has shading indicative of magnetic fields with peak magnitude of 0.71 MA/m, while FIG. 3B has shading indicative of electric fields with peak magnitude ~325 MV/m. Beam pipe 304 is positioned along the longitudinal axis of the device.

The accelerating cell has a nose cone 308 in order to increase the shunt impedance. This nose cone 308 increases shunt impedance of the cell but cuts-off field propagating into the beam pipe and therefore all power flows along the structure in the outside waveguide 302.

The structure is symmetric with respect to the beam axis, so it has no dipole field component deflecting the beam. Remaining quadruple components could either be used to focus the beam or eliminated by slightly distorting accelerating cell shape.

A key distinction between this structure and either side-coupled, on-axis coupled or parallel-coupled SW structures it that the wave travels in it with significant group velocity. In this property it is similar to traditional on-axis-coupled TW accelerating structures, but without the drawback of low shunt impedance or increased RF breakdown probability due to RF power flow through accelerating cavity.

An important property of a traveling wave structure is the absence of parasitic modes, propagating at working frequency. Parasitic modes make electrical design of the input coupler complicated and tighten manufacturing tolerances to satisfy requirements on the working mode stability. Simulations by the inventor show that this TW structure is single moded, as seen in FIGS. 4A-B, where the dispersion diagram is shown for one cell of the TW structure shown in FIGS. 3A-B. Specifically, FIG. 4A is a graph of frequency vs. phase advance per cell showing full frequency span with two lowest brunches; FIG. 4B is a graph of frequency vs. phase advance per cell showing 400 MHz frequency span. As seen in FIG. 4B, at the working point ($2\pi/3$ phase advance per cell), only the operating mode is propagating.

Table 1 shows a comparison between parameters for the traveling-wave structure of an embodiment of the invention and those of a typical side-coupled standing wave structure. The structures were simulated using HFSS.

TABLE 1

| Parameter | TW with outside power flow | SW, side-coupled |
|---|---|---|
| Cell length [mm] | 10.745 | 16.104 |
| Aperture radius "a" [mm] | 1.14 | 1.14 |
| a/lambda | 0.035 | 0.035 |
| Frequency [GHz] | 9.3 | 9.3 |
| Q-value | 6802 | 7917 |
| Phase Advance per Cell [deg.] | 120 | 180 |
| Group Velocity [speed of light] | 0.013 | 0 |
| Attenuation Length [m] | 0.47 | — |
| Shunt Impedance [MOhm/m] | 144 | 143 |
| R/Q [kOhm/m] | 21.2 | 18.1 |
| Accelerating Gradient [MV/m] | 100 | 100 |
| RF Power Flow [MW] | 32.25 | — |
| Peak Electric Field [MV/m] | 325 | 550 |
| Peak Magnetic Field [kA/m] | 710 | 1500 |
| Emax/Eacc | 3.25 | 5.5 |
| Hmax*Z0/Eacc | 2.7 | 5.7 |
| RF Losses per Cell [MW] | 0.74 | 1.12 |
| Stored Energy per Cell [mJ] | 87 | 152 |

Figure 3B:
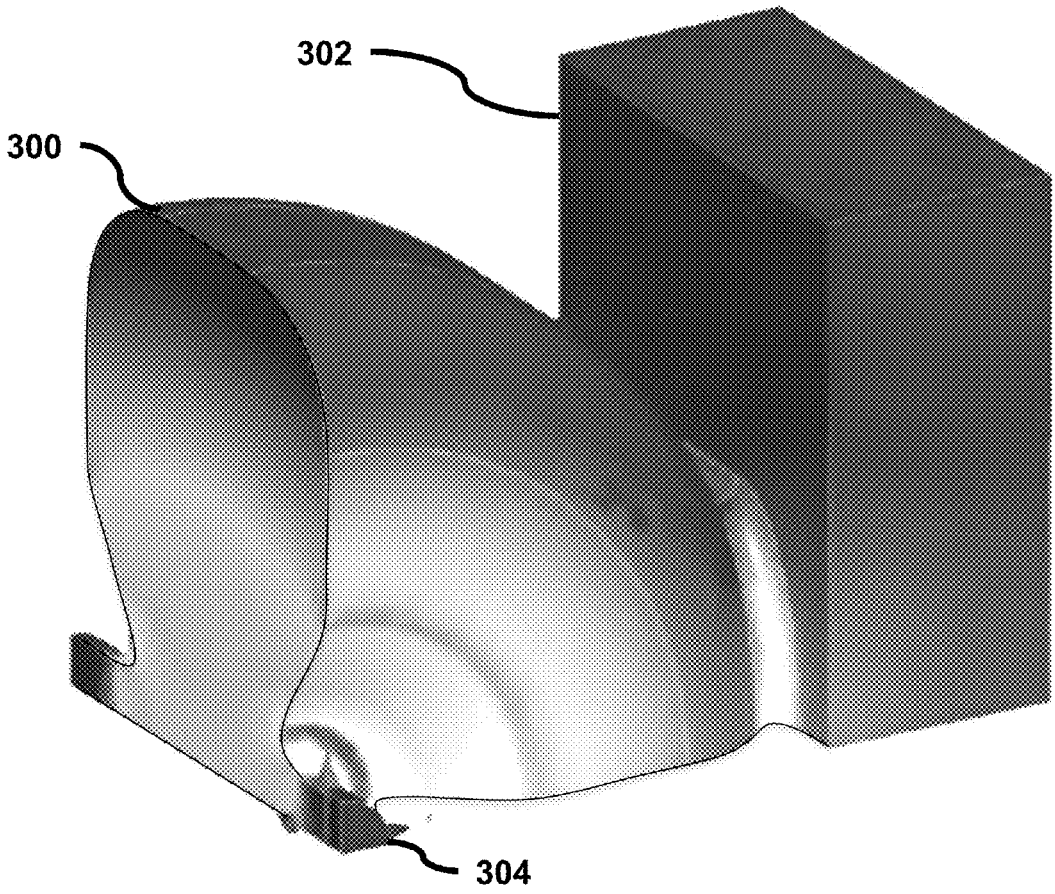
Figure 4A:
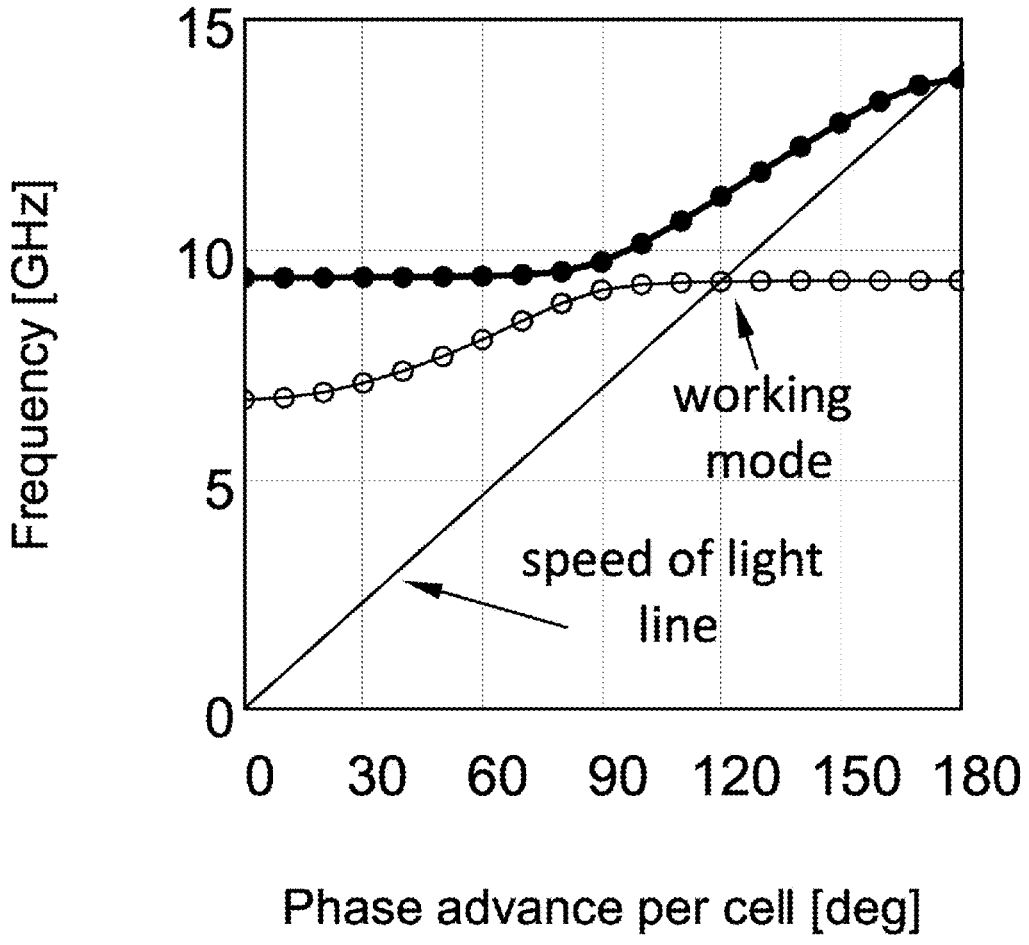
FIGS. 4A and 4B are dispersion diagrams for one cell of the TW structure shown in FIGS. 3A-B showing a full frequency span with two lowest brunches and 400 MHz frequency span, respectively.
Figure 4B:
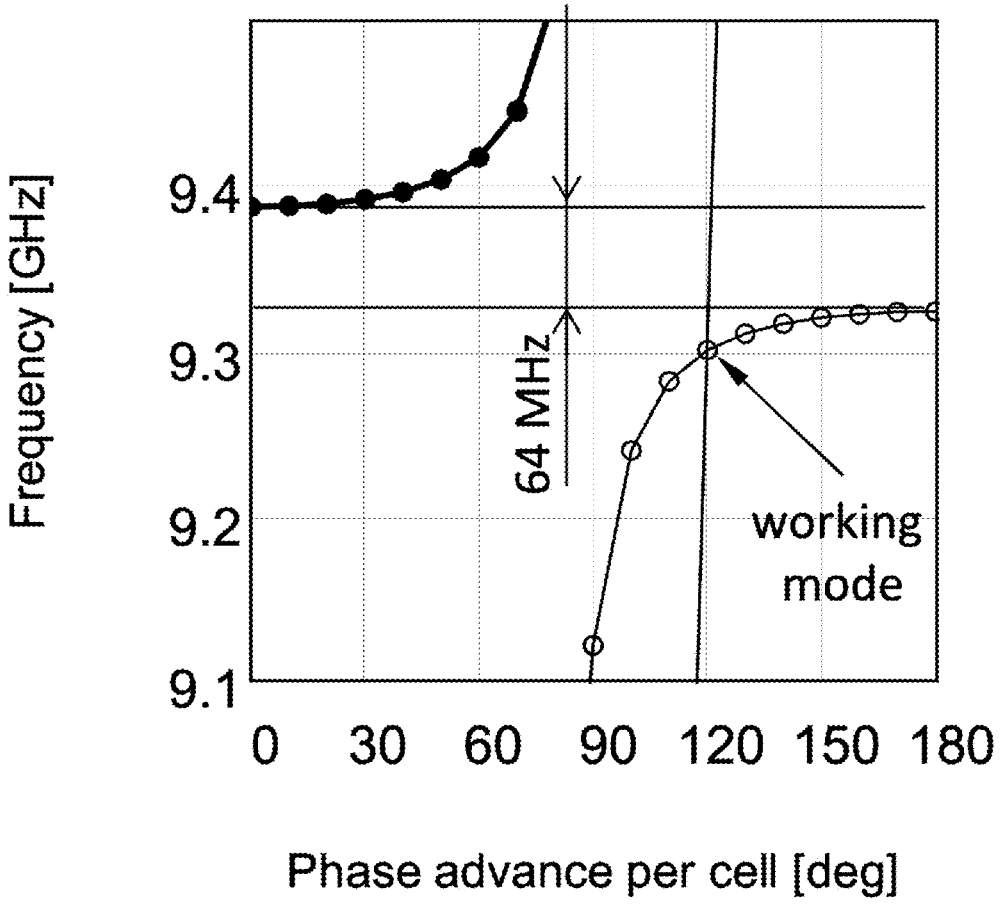

Table 1 illustrates a quantitative comparison between a typical side-coupled standing wave structure and the proposed traveling wave structure shown in FIGS. 3A-B. Both structures will accelerate an ultra-relativistic beam moving with close-to-speed of light velocity. As seen in the table, both structures have practically identical shunt impedance. At the same time, the TW structure of the present invention has lower peak surface electric and magnetic fields, lower stored energy and power lost per cell. The inventors envision that with other advantages brought by use of traveling wave and symmetric feed, linacs build with this type of accelerating structure will have superior performance to both commonly used side-coupled standing wave structures and to the parallel-coupled standing wave structures.

In conclusion, the traveling wave accelerating structure of the present invention has high shunt impedance similar to that of side-coupled standing-wave accelerating structure, but without its drawbacks. It does not need a waveguide isolator, has no deflecting on-axis fields or power flow through the accelerating cell, it is simple to tune and characterize electrically. Possible uses of the structure are compact, high repetition rate medical or industrial accelerators.

The invention claimed is:

1. A traveling wave accelerator structure comprising: a symmetric RF feed; an input matching cell coupled to the symmetric RF feed; a sequence of regular accelerating cavities coupled to the input matching cell at an input beam pipe end of the sequence; a waveguide parallel to the sequence of regular accelerating cavities, an output matching cell coupled to the sequence of regular accelerating cavities at an output beam pipe end of the sequence of regular accelerating cavities; and output waveguide circuit or RF loads coupled to the output matching cell, wherein the waveguide is coupled at an input end to the symmetric RF feed, coupled at an output end to the output waveguide circuit or RF loads, coupled to the input matching cell, coupled to the output matching cell, and coupled to each of the cavities in the sequence of regular accelerating cavities, wherein each of the regular accelerating cavities has a nose cone that cuts-off field propagating into the beam pipe such that all power flows in a traveling wave along the structure in the waveguide.

2. The traveling wave accelerator structure of claim 1 wherein the symmetric RF feed is an input waveguide circuit comprising an input waveguide, matched splitter, two matched H-plane bends, and a matched E-plane bend.

3. The traveling wave accelerator structure of claim 1 comprising multiple input matching cells coupled to the waveguide and to the symmetric RF feed.

4. The traveling wave accelerator structure of claim 1 wherein the regular accelerating cavities have different length from input to output to facilitate bunching of the beam and to match velocity of the beam when accelerated from low energies.

* * * * *